US005522232A

United States Patent [19]

Nojiri

[11] Patent Number: 5,522,232

[45] Date of Patent: Jun. 4, 1996

[54] FROST DETECTING DEVICE

[75] Inventor: Toshiyuki Nojiri, Tokyo, Japan

[73] Assignee: Ishizuka Electronics Corporation, Tokyo, Japan

[21] Appl. No.: 429,261

[22] Filed: Apr. 25, 1995

[30] Foreign Application Priority Data

Sep. 19, 1994 [JP] Japan ..... 6-223482

[51] Int. Cl.[6] ..... F25D 21/02

[52] U.S. Cl. ..... 62/140; 62/156

[58] Field of Search ..... 62/140, 151, 156, 62/128; 340/580, 581

[56] References Cited

U.S. PATENT DOCUMENTS

| | | | |
|---|---|---|---|
| 3,039,278 | 6/1962 | Thompson | 62/140 |
| 3,220,208 | 11/1965 | Oram et al. | 62/140 |
| 3,362,183 | 1/1968 | Sutton, Jr. | 62/140 |
| 3,383,877 | 5/1968 | Liebermann et al. | 62/140 |
| 3,822,560 | 7/1974 | Hansen et al. | 62/151 X |
| 4,345,441 | 8/1982 | Hansen | 62/156 X |
| 5,345,775 | 9/1994 | Ridenour | 62/156 X |

FOREIGN PATENT DOCUMENTS

| | | |
|---|---|---|
| 1-312378 | 12/1989 | Japan . |
| 2-013774 | 1/1990 | Japan . |
| 2-115678 | 4/1990 | Japan . |

*Primary Examiner*—Harry B. Tanner

*Attorney, Agent, or Firm*—Lowe, Price, LeBlanc & Becker

[57] ABSTRACT

A frost detecting device for detecting adhesion of the frost, a slit-like opening is formed on the inside of a container with a hollow portion, a thermally sensitive element such as a thermistor is arranged on the inside of the hollow portion, leads of the thermally sensitive element are mounting to exterior through a penetrating hole provided for a metallic plate, the leads are fixed to the metallic plate, the slit-like opening is blocked by adhesion of the frost. An inside of the container is interrupted from ambient atmosphere, a temperature on the inside of the container drops, a quantity of adhesion of the frost can be detected by detecting difference in temperature between non frost state and adhesion of the frost state. Further two containers are provided. The respective thermally sensitive elements are arranged at each of two containers one of which is provided with openings, the other of which is provided with a thermally sensitive element for compensating temperature in such a manner that the thermally sensitive element is hermetically fixed. Accordingly, it's possible to heighten detecting accuracy of adhesion of the frost.

10 Claims, 12 Drawing Sheets

CHARACTERISTICS OF THE FROST SENSOR

FROST DETECTING DEVICE

BACKGROUND OF THE INVENTION

1. Field of the Invention

The present invention relates to a frost detecting device for defrosting control which is used in various industrial instruments and cold storage instruments such as refrigerators.

2. Description of the Prior Art

In general, with reference to the refrigerator, the adhesion of the frost to the surface of the cooling fin of the heat-exchanger which is incorporated into the refrigerator, deteriorates refrigerating efficiency of the cold storage instruments. If the refrigerator continues to operate on the state of adhesion of the frost remaining left as it is, not only it becomes uneconomical because of remarkable deterioration of the consumption efficiency of energy, but also it becomes a cause of a malfunction.

Accordingly, with reference to the refrigerators, a refrigerating means is operated for a definite time in such a manner that the operation lasts until the time when the time integrated reaches a fixed time. A heater is switched on in stead of the refrigerating means to defrost the refrigerator. The heater is switched off after reaching a fixed time.

In this method, a start of defrosting can be controlled by time. However, each of the states of adhesion of the frost differs mutually caused by an ambient temperature of the refrigerator, humidity, open-and-shut frequency of the door, and the state of articles such as temperature, amount of evaporation, heat capacity etc. Consequently, the state of adhesion of the frost can not be controlled by only time. Further, since this method can not detect the real state of adhesion of the frost, even if the refrigerator is in non-frost state, defrosting may be performed, contrary to the above situation, although the refrigerator is in super-frost state, defrosting may not be performed. As a result thereof, the inefficient refrigerating operation with regard to energy was performed.

Under these situations, the following frost detecting methods have been developed:

(1) As shown in FIG. 13A, optical means; a light emitting element 20, a photo detector 21 are used. When light irradiated from the light emitting element 20 reflect at the reflecting surface 22, an occurrence of adhesion of the frost is detected by detecting change in quantity of light with gaps of the angle of incidence for incident light which is directed to the photo detector 21, corresponding to the amount of adhesion of the frost or by sensing an index of reflection for incident light.

(2) This is a method in which the difference in temperature is detected. The occurrence of adhesion of the frost is detected by detecting the difference in temperature either the refrigerating means or the circumference thereof before and after adhesion of the frost.

(3) As shown in FIG. 13A, this is the method in which the change in resonant frequency of the piezoelectric vibrator is detected. The piezoelectric vibrator 25 is supported by the flexible supporting body 24 which is provided with the housing 23. The electrode 26 is mounted on the surface of the piezoelectric vibrator 25. The resonant frequency changes when the frost is adhered to the piezoelectric vibrator 25. The occurrence of adhesion of the frost is detected by detecting the change in the resonant frequency when the quantity of adhesion of the frost exceeds the fixed value, as to be the state of adhesion of the frost.

(4) The conditions which are the time integrated for operating of the compressor, open-and-shut frequency of the door, the temperature of the air outside etc. are integrated by the micro computer. The presence or absence of adhesion of the frost is judged in such a manner that the state of adhesion of the frost is presumed by the control program.

However, the usual detecting method of the adhesion of the frost has following defects.

In the optical detecting method of the above (1), it is difficult to miniaturize the detecting part. In order to maintain the detecting accuracy the periodical maintenance such as cleaning of the reflecting surface for light becomes necessary. Further, since the circuit structure thereof becomes complex, there is a defect which brings cost-up.

In the method for detecting difference in temperature of the above (2), it is difficult to obtain the accurate detecting value because the quantity of adhesion of the frost detected vary widely. Accordingly there are a lot of practical problems.

In the method using the piezoelectric vibrator of the above (3), dusts or the like may cling onto the piezoelectric vibrator. The vibration caused by the inside of the cooling instruments or the outside thereof affects the frost detecting accuracy. There is faulty operation of the detecting instruments by these effects.

In the method of the time integrated for operating of compressor and so forth of the above (4), there are differences of degree for the adhesion of the frost because of season, weather and using condition of the compressor. There may be defects that energy efficiency becomes poor if uses require, because there are differences of the degree of adhesion of the frost on account of season, weather and using the compressor.

SUMMARY OF THE INVENTION

In view of the foregoing, it is an object of the present invention to provide a frost detecting device size of which is small, which is stable on the environmental condition, which is extremely precise for frost detecting and repeatability of which is fine.

According to the first aspect of the present invention, for achieving the above-mentioned object, there is provided a frost detecting device comprising a container which has thermal conductivity, a thermally sensitive element mounting into the container, and openings which are blocked by adhesion of a frost, provided for the container.

According to the second aspect of the present invention, there is provided a frost detecting device comprising a container which has thermal conductivity, a first and a second hollow portions within the container, openings which are blocked by adhesion of a frost, provided for the first hollow portion of the container, a first thermally sensitive element mounting into the first hollow portion, and the second sensing element mounting into the second hollow portion.

According to the third aspect of the present invention, there is provided a frost detecting device comprising a container which has thermal conductivity, a first thermally sensitive element mounting into the container, openings which are blocked by adhesion of a frost, provided for the container, and a second thermally sensitive element hermetically fixed into a cavity bored into a formative parts of the container.

According to the fourth aspect of the present invention, there is provided a frost detecting device in which the container with respect to each of the first to third aspects of the frost detecting device has a rectangular parallelepiped shape or semicylindrical shape or spherical shape.

According to the fifth aspect of the present invention, there is provided a frost detecting device comprising the first and the second containers which have thermal conductivity, and each of which has cylindrical shape or spherical shape, openings which are blocked by adhesion of a frost, provided for the first container, a partition wall which is provided between the first and the second containers, a flange which is provided at about the center of the first and the second containers, and the first and the second thermally sensitive elements mounting into each of the first and the second containers.

According to the sixth aspect of the present invention, there is provided a frost detecting device in which an opening part with respect to each of the first to fifth aspects of the frost detecting devices is formed into slit-like form.

According to the seventh aspect of the present invention, there is provided a frost detecting device in which a container with respect to each of the first to fifth aspects of the frost detecting devices is made of aluminum, zinc, copper, iron, titanium or an alloy which is made of the principal ingredients thereof.

According to the eighth aspect of the present invention, there is provided a frost detecting device in which at least one of the openings formed into the container with respect to each of the first to fifth aspects of the frost detecting device combines the use of temperature detection and the draindown.

According to the ninth aspect of the present invention, there is provided a frost detecting device in which the width of the slit-like opening with respect to the first to fifth aspects of the frost detecting devices is employed for conversion of the quantity of adhesion of the frost.

As stated above, the frost detecting device according to the first aspect of the present invention in which since the thermally sensitive element is arranged on the inside of the hollow portion of the container, and the openings are formed into the container, the temperature of the air outside atmosphere is detected by means of the thermally sensitive element through the openings, when the openings are blocked by adhesion of the frost, the thermally sensitive element within the hollow portion detects the temperature of the cooling fin of the heat exchanger equipped with the frost detecting device.

With regard to the detection of adhesion of the frost, the state of adhesion of the frost is detected in such a way that before and after state of adhesion of the frost with regard to the difference in temperature is detected by means of the thermally sensitive element in accordance with the blocking of the openings by adhesion of the frost.

As stated above, the frost detecting device according to the second aspect of the present invention in which there are provided the container for containing the thermally sensitive element for detecting the temperature when the openings are blocked by the frost, and the different container for containing the thermally sensitive element for compensating temperature to eliminate the detecting error.

The thermal time constant becomes same on account of the manner in which the structure of the both containers is made same. The both thermally sensitive elements simultaneously detect the changes of the temperature of the cooling fin. Accordingly, it's possible to cancel the influences of the environmental temperature, the difference in temperature before and after states of adhesion of the frost is accurately detected.

As stated above, the frost detecting device according to the third aspect of the present invention in which the first thermally sensitive element is allocated on the inside of the hollow portion of the container, the second thermally sensitive element for detecting the temperature of the cooling fin hermetically fixed into the cavity which is bored in the container parts. It's possible to heighten the detecting accuracy except the occurrence error in detection by detecting the temperature of the cooling fin using the second thermally sensitive element.

As stated above, the frost detecting device according to the fourth aspect of the present invention in which the shape of the container is selected from one of the rectangular parallelepiped shape and semicylindrical shape and spherical shape. It can be made the best shape for frosting taking account of the air stream in the vessel of the freezing instruments.

As stated above, the frost detecting device according to the fifth aspect of the present invention in which the flange is fixed on the container. The container is installed in the hole of the heat exchanger and the vessel of freezing instruments through the flange. The container can be made the best shape for frosting taking account of the air stream in the vessel of the freezing instruments. It's possible to heighten the detecting accuracy.

As stated above, the frost detecting device according to the sixth aspect of the present invention in which the openings of the frost detecting device concerning the first to fifth aspects are the slit-like shape. Since the openings are simultaneously blocked by the frost adhered, the temperature change becomes steep. Accordingly it's possible to heighten the detecting accuracy.

As stated above, the frost detecting device according to the seventh aspect of the present invention in which the container of the frost detecting device concerning the first to fifth aspects is made of the materials the quality of which has good thermal conductivity. Accordingly, it's possible to heighten detecting accuracy of response property.

As stated above, the frost detecting device according to the eighth aspect of the present invention in which the openings of the frost detecting device concerning the first to fifth aspects combine the use of the temperature detection and the draindown. At least one of the openings is employed as the hole for draindown. Since the drop of water of the defrosting is not gathered, it's possible to heighten the detecting accuracy.

As stated above, the frost detecting device according to the ninth aspect of the present invention in which the width of the slit-like opening is employed for establishment of the quantity of adhesion of the frost (thickness). It's possible to perform the quantitative detection of adhesion of the frost.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

DETAILED DESCRIPTION OF THE PREFERRED EMBODIMENTS

A preferred embodiment of the invention will now be described in detail referring to the accompanying drawings.

[Embodiment 1]

Figure 1A:
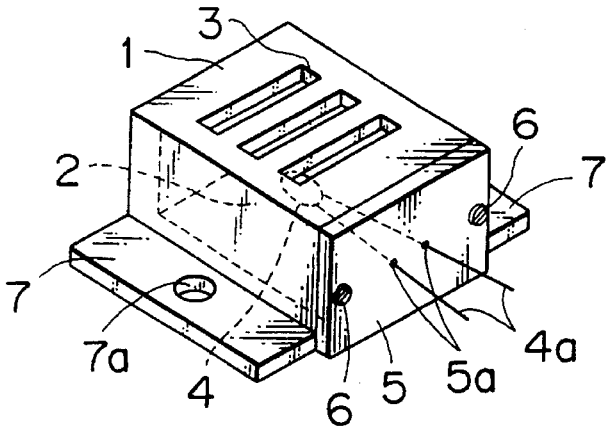
FIG. 1A is a perspective view showing the first embodiment of a frost detecting device according to the present invention.
Figure 1B:
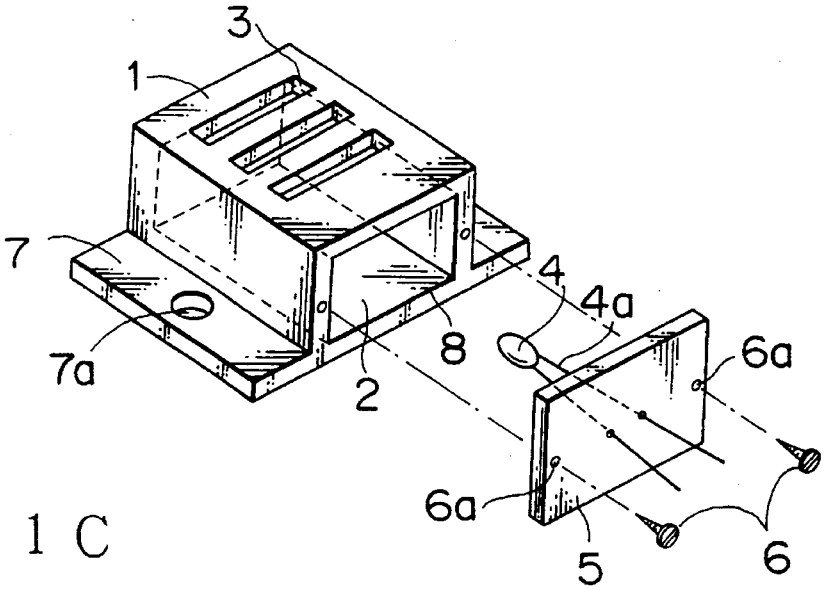
FIG. 1B is an exploded perspective view of FIG. 1A.

FIG. 1A is a perspective view showing the first embodiment of a frost detecting device according to the present invention, FIG. 1B is an exploded perspective view of FIG. 1A.

In FIGS. 1A and 1B, designated 1 is a container which has thermal conductivity made of a metal such as Aluminum, Copper and so forth. Slit-like openings 3 are formed at least one surface of the container 1. A hollow portion 2 on the inside of the container 1 opens to the air outside by the openings 3. A tongue-like piece 7 with a hole 7*a* for installing is provided for the container 1. A thermally sensitive element 4 such as the thermistor element and so forth is arranged on the inside of the hollow portion 2 of the container 1 so as not to contact the inner wall thereof. A lead 4*a* of the thermally sensitive element 4 is firmly fixed isolatedly to a metallic plate 5. The lead 4*a* is inserted through into a penetration 5*a* of the metallic plate 5. The lead 4*a* is introduced outward. The metallic plate 5 is fastened to the container 1 so as to block an opening part 8 in such a manner that a screw 6 is inserted into a penetration 6*a* of the metallic plate 5 and tightened into a threaded hole of the container 1.

Figure 1C:
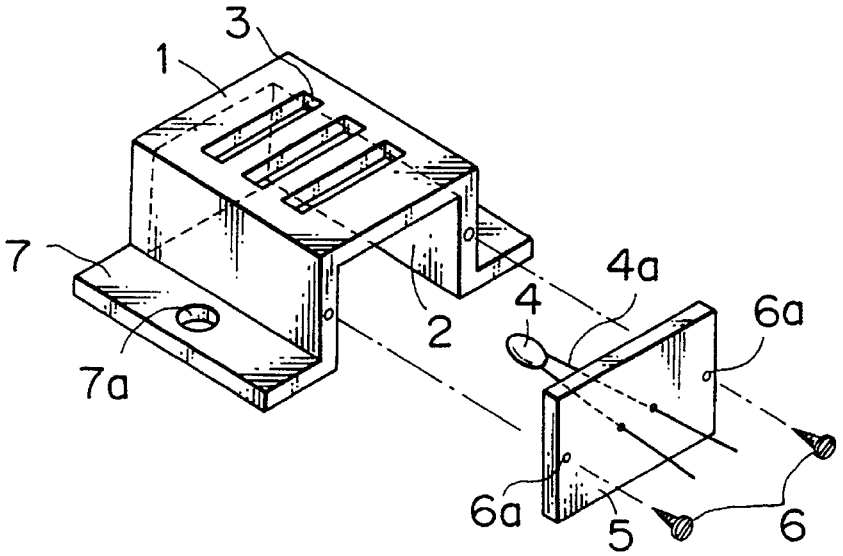
FIG. 1C is an exploded perspective view showing a deformed embodiment of a container according to the present invention.

FIG. 1C is an exploded perspective view showing a deformed embodiment of a container. In the case where the container is directly fastened on the cooling fin of the heat exchanger, the base portion of the container 1 is not always necessary. It may be permitted that the base portion is opened.

Further, in the case of this embodiment the metallic plate 5 may be integrally formed with the container 1. The thermally sensitive element 4 can be inserted from the opened base portion.

Besides, in this embodiment, although the shape of the container 1 is rectangular parallelepiped, it is clearly permitted that the shape of the container is selected from one of semicylindrical shape and spherical shape.

Next, operation of this device according to the first embodiment will be described. The frost detecting device is fixed on the cooling fin of the heat exchanger on the inside of the vessel of the cooling instruments. The temperature on the inside of the vessel is held 10 degrees C. above zero. The surface temperature of the cooling fin of the heat exchanger is set to for example, 10 degrees C. below zero. Namely, at the location where the frost detecting device is installed the difference in temperature comes into existence between the surface temperature of the cooling fin of the heat exchanger and the ambient temperature.

At first, the opening 3 is opened because the surface of the frost detecting device is the state of no adhesion of the frost. Accordingly, the inside of the hollow portion 2 is affected by the temperature of the inside of the vessel through the opening 3. The thermally sensitive element 4 detects the temperature on the inside of the vessel. The thermally sensitive element detects the temperature which is a little higher than the surface temperature of the cooling fin. As time passes, the frost adheres to the surface of the frost detecting device. Further, as the adhesion of the frost progresses, the openings 3 are blocked. On the inside of the hollow portion 2, ventilation from the air outside deteriorates. When the openings 3 are entirely blocked by frost, the temperature on the inward side of the hollow 2 becomes approximately the same temperature as the cooling fin.

The previous temperature of adhesion of the frost is detected in advance. The transition of temperature after adhesion of the frost is also detected. The both of temperatures are compared with each other. Thus the above-described frost detecting device can detect the adhesion of the frost from the difference in temperature.

However, the surface temperature of the cooling fin varies with respect to the effect of operation and interruption of the heat exchanger, and with respect to the effect of disturbance of the surrounding air and so forth. In the method of the above frost detecting device in which difference in temperature is detected by means of the one thermally sensitive element as described embodiment, detecting error might occur. Accordingly, it might be difficult to detect accurately the state of adhesion of the frost in accordance with the ambient condition.

In the frost detecting device with one thermally sensitive element, the detecting circuit of the adhesion of the frost is configured so as to start detecting the adhesion of the frost after steady state passing certain period of time. The temperature of the steady state is lower than the previous temperature of the adhesion of the frost. Thus the accurate state of the adhesion of the frost can be detected.

[Embodiment 2]

Figure 2A:
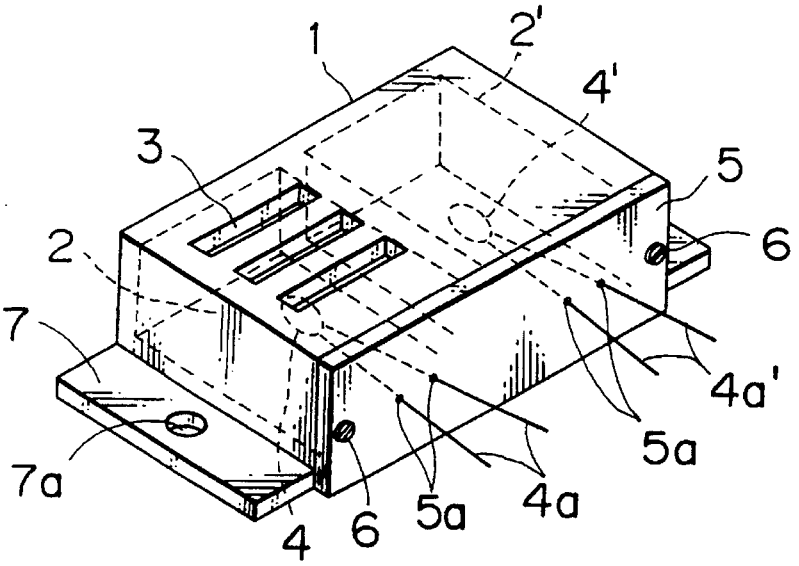
FIG. 2A is a perspective view showing the second embodiment of the frost detecting device according to the present invention.
Figure 2B:
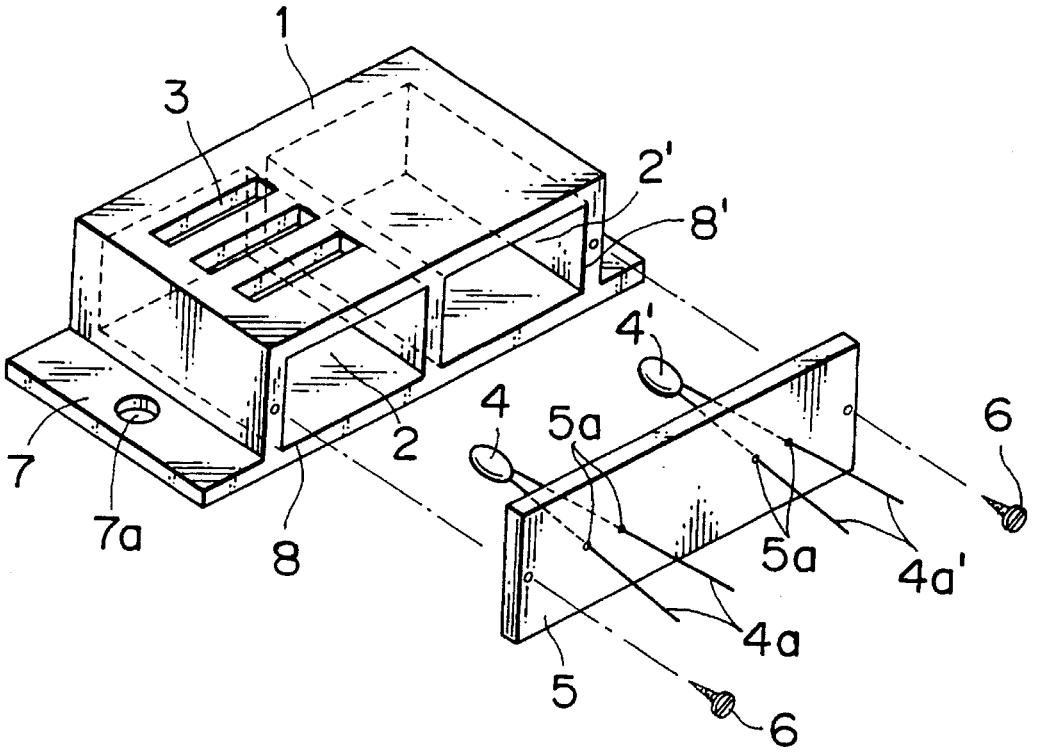
FIG. 2B is an exploded perspective view of FIG. 2A.

FIG. 2A is a perspective view showing the second embodiment of the frost detecting device according to the present invention, FIG. 2B is an exploded perspective view of FIG. 2A. In FIGS. 2A and 2B, designated 1 is a container which has thermal conductivity made of a metal such as Aluminum, Copper and so forth. Hollow portions 2, 2' are formed on the container 1. One side of the hollow portions 2, 2' is opening part 8, 8'.

Slit-like openings 3 are formed at least one surface of the container 1. A hollow portion 2 on the inside of the container 1 opens to the atmosphere in the vessel of the cooling instruments by the openings 3. A tongue-like piece 7 with a hole 7*a* for installing is provided for the container 1. Thermally sensitive elements 4, 4' such as the thermistor element and so forth are arranged on the inside of the hollow portions 2, 2' of the container 1 so as not to contact the inner wall thereof. Leads 4*a*, 4*a'* of the thermally sensitive elements 4, 4' are firmly fixed isolatedly to a metallic plate 5. The lead 4*a*, 4*a'* are inserted through into a penetration 5*a* of the metallic plate 5. The lead 4*a* is introduced outward. The metallic plate 5 is fastened to the container 1 so as to block opening parts 8, 8' in such a manner that a screw 6 is inserted into a penetration 6*a* of the metallic plate 5 and is tightened into a threaded hole of the container 1. The hollow portion 2' is hermetically sealed.

Figure 3:
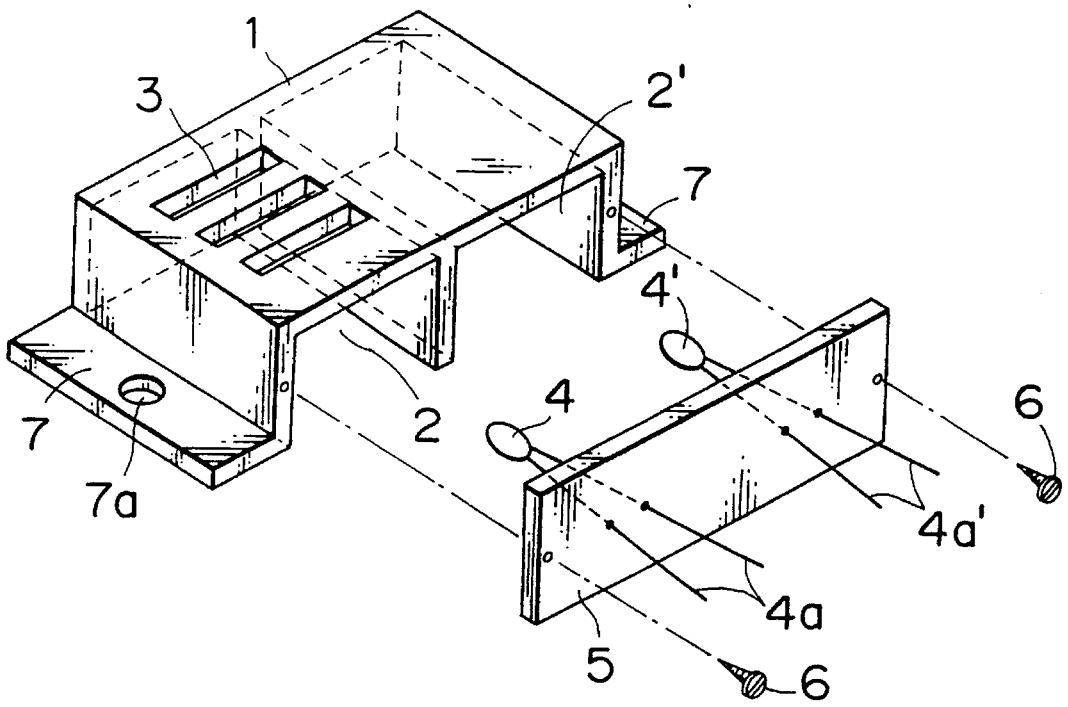
FIG. 3 is an exploded perspective view showing the other embodiment of the second embodiment.

FIG. 3 is an exploded perspective view showing a deformed embodiment of a container. In the case where the container is directly fastened on the cooling fin of the heat exchanger, the base portion of the container 1 is not always necessary. It may be permitted that the base portion is opened. The frost detecting device is fastened to the cooling fin in such a manner that a screw is inserted into a hole 7*a* of the tongue-like piece 7 and is tightened into a threaded hole of the cooling fin.

Besides, in this embodiment, although the shape of the container 1 is rectangular parallelepiped, it is clearly permitted that the shape of the container is selected from one of semicylindrical shape and spherical shape.

Next, operation of this device according to the second embodiment will be described.

As explained above, the temperature on the inside of the vessel is held 10 degrees C. above zero. The surface temperature of the cooling fin of the heat exchanger is set to for example, 10 degrees C. below zero. At first, the openings 3 are opened because the surface of the frost detecting device is the state of no adhesion of the frost. Accordingly, the inward side of the hollow portion 2 is affected by the temperature on the inside of the vessel through the openings 3. The thermally sensitive element 4 detects the temperature on the inside of the vessel. The thermally sensitive-element 4' detects the temperature on the inside of the hollow portion refrigerated by the cooling fin.

Consequently, both of the temperature on the inside of the vessel and the surface temperature of the cooling fin can be detected by detecting the temperature on the inside of the hollow portions 2, 2' respectively using the thermally sensitive elements 4, 4'.

Figure 4:
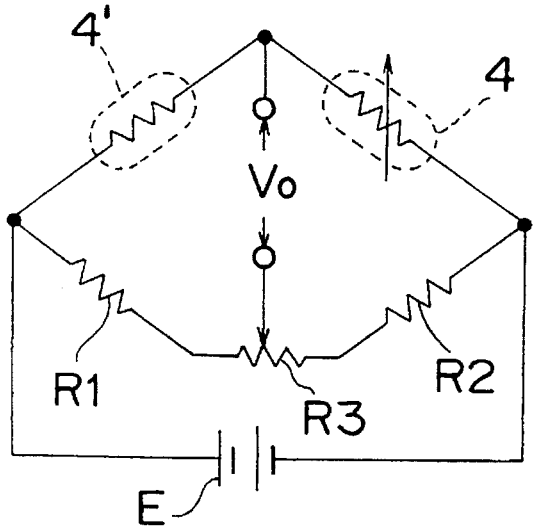
FIG. 4 is a circuit diagram showing a frost detecting circuit.

The difference in temperature detected by the thermally sensitive elements 4, 4' can be disclosed by the frost detecting circuit as shown in FIG. 4. In FIG. 4, designated 4, 4' are thermally sensitive elements provided for the hollow portions 2, 2' respectively, the bridge circuit is composed of the thermally sensitive element 4, 4', the resistors R1, R2 and the variable resistor.

When there exists the difference in temperature by the thermally sensitive elements 4, 4', the value of resistor is fixed. Since the resistance change of the thermally sensitive element 4 occurs, the output voltage $V_0$ is generated between the connecting point of the thermally sensitive elements 4 and 4' and sliding contact point of the variable resistor R3. The potential of the output voltage $V_0$ represents the difference in temperature.

Figure 5:
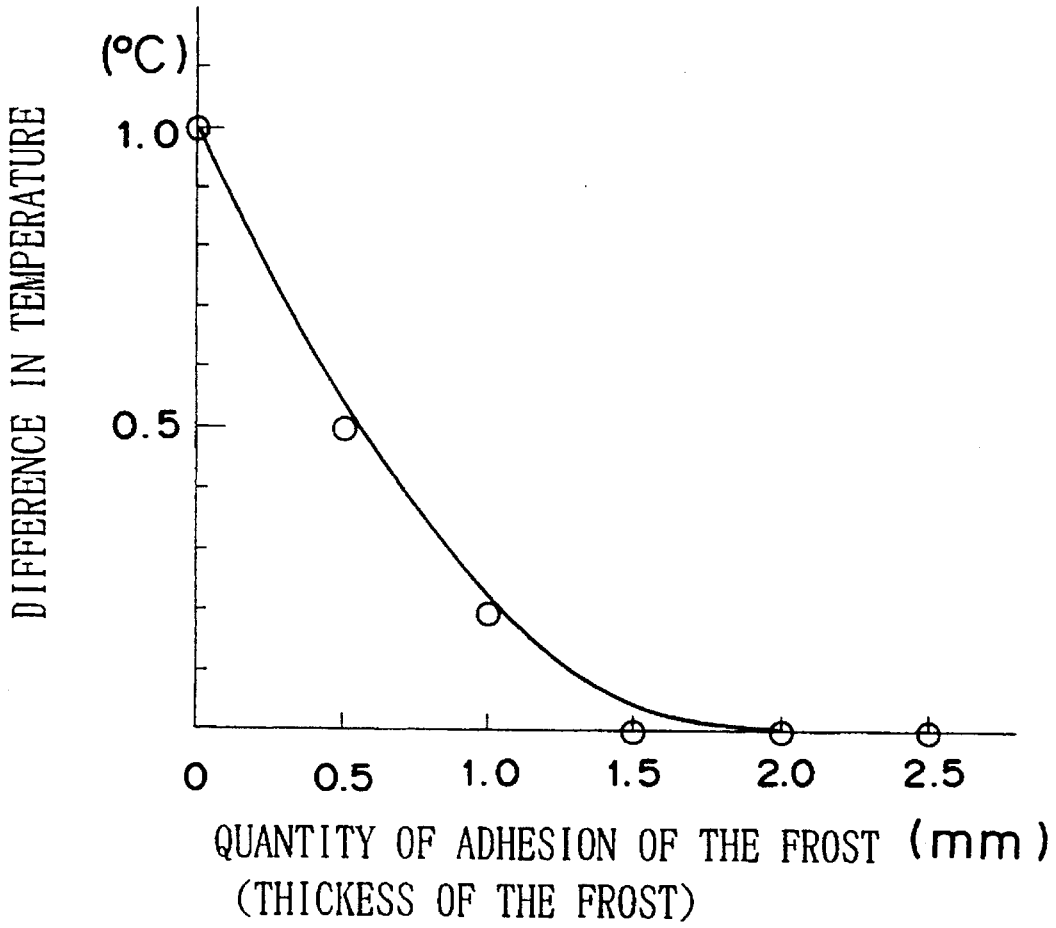
FIG. 5 is a view showing output characteristics of the frost detecting circuit.

FIG. 5 is a diagram showing output characteristics of the frost detecting circuit of FIG. 4. In FIG. 4, the horizontal axis shows the quantity adhesion of the frost (thickness of the frost), and the vertical axis shows the difference in temperature.

According to the result of experimentation for the embodiment of FIG. 3, there occurs the difference in temperature of one degree C. in non-frost state. With passing time, the frost adheres to the surface of the frost detecting device, ventilation of the air decreases because the area of the openings decrease thereby the difference in temperature reduces on the atmosphere of the hollow portions 2, 2'. Further when the openings 3 are blocked by the increase of adhesion of the frost, the temperature of the hollow portion 2 equals to that of the hollow portion 2', as a result thereof, the difference in temperature detected by the thermally sensitive element 4, 4' becomes zero.

Accordingly, the quantity of adhesion of the frost (thickness of the frost) can be detected by detecting the difference in temperature of the hollow portions 2, 2'. The effect of variation in temperature for the cooling fin according to operation and interruption of the heat exchanger can be corrected by the thermally sensitive element 4' in use for compensation of the temperature. Consequently, the quantity of adhesion of the frost is very accurately detected.

Further, in the case of the frost detecting device, the width of the slit of the opening 3 is 2 mm. As stated above reasons, it is clear that the different quantity of adhesion of the frost can be detected by changing the width of the slit of opening 3.

[Embodiment 3]

FIGS. 6A, 6B and 7A, 7B show the other embodiments of the frost detecting device according to the present invention. In these embodiments, there is not provided a tongue-like piece with a hole in use for installing. The constitution is permitted if the engaging means is provided for the side where the frost detecting device is installed.

Figure 6A:
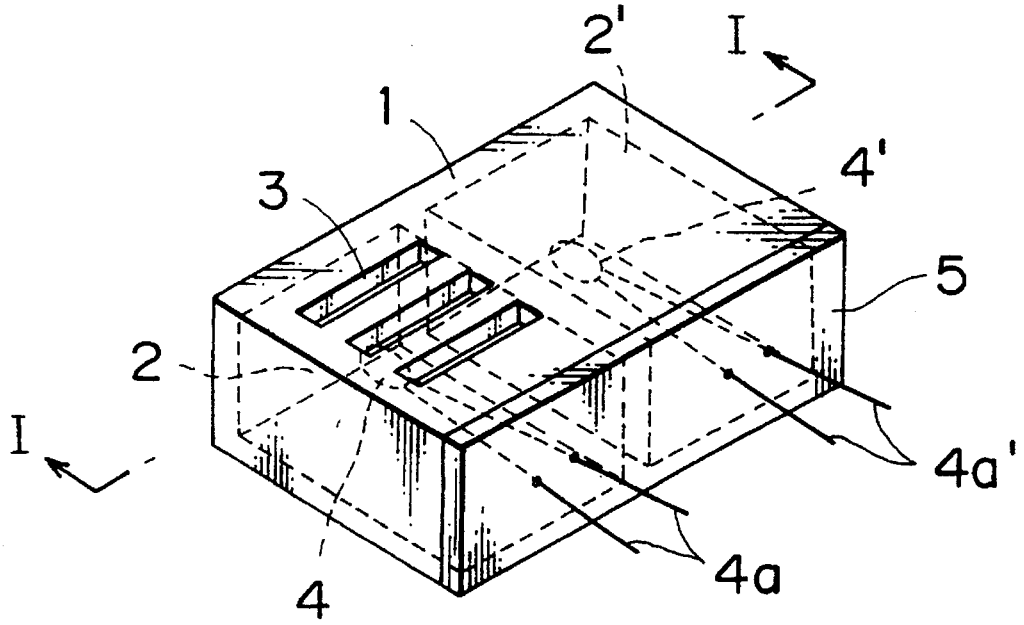
FIG. 6A is a perspective view showing the third embodiment of the frost detecting device according to the present invention.
Figure 6B:
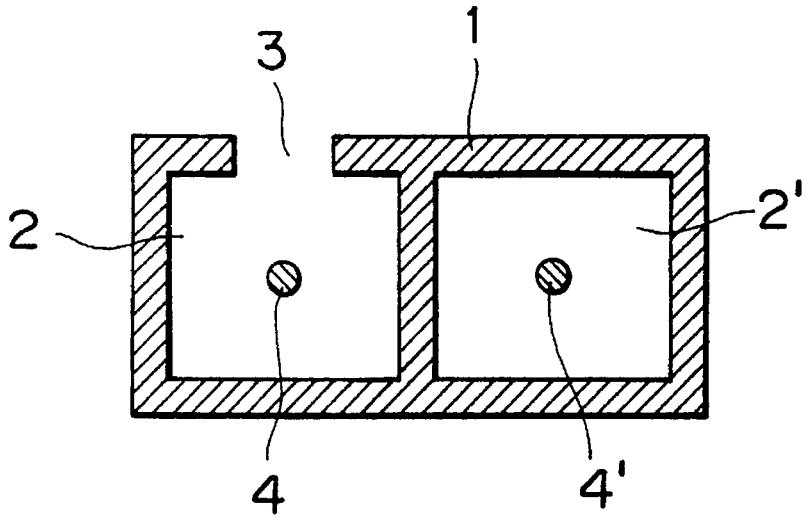
FIG. 6B is a cross sectional view taken along the line I—I of FIG. 6A.

FIG. 6A is a perspective view showing the third embodiment of the frost detecting device according to the present invention, FIG. 6B is a cross sectional view taken along the line I—I of FIG. 6A. In FIG. 6A, difference between the embodiment of FIG. 2 and that of FIG. 6A is that the tongue-like piece with a hole for mounting the frost detecting device is not provided for the container 1. The explanation with respect to the other configurations will be omitted because the other configurations are the same as the embodiment of FIG. 2.

Figure 7A:
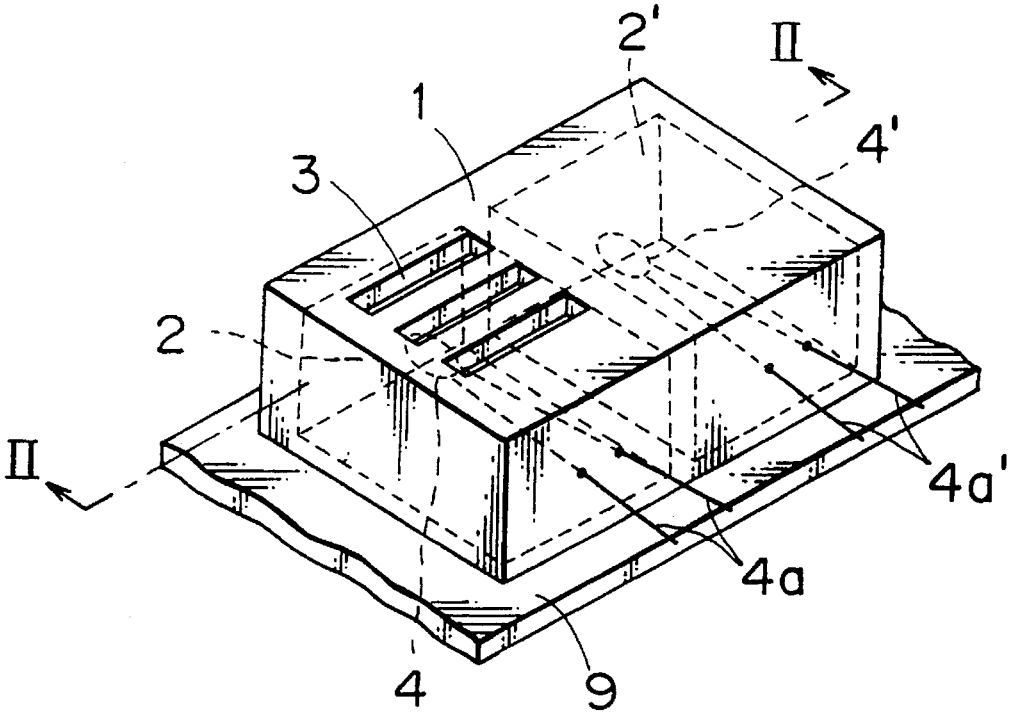
FIG. 7A is a perspective view showing the third embodiment of the frost detecting device according to the present invention.
Figure 7B:
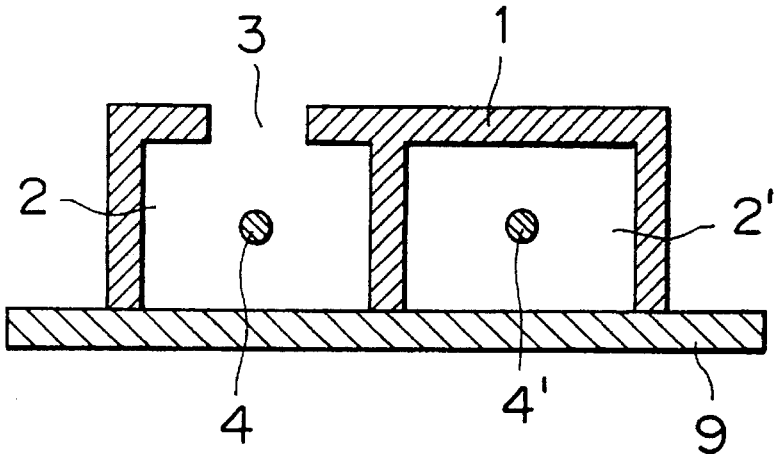
FIG. 7B is a cross sectional view taken along the line II—II of FIG. 7A.

FIG. 7A is a perspective view showing the state where the frost detecting device is mounted on the cooling fin, FIG. 7B is a cross sectional view taken along the line II—II of FIG. 7A. In the embodiment of FIG. 7A, the base portion of the container 1 is opened. The metallic plate 5 of the embodiment of FIGS. 6A, 6B is integrally formed with the container 1. The opened base portion is fixed to the cooling fin 9. The thermally sensitive elements 4, 4' can be inserted for assembling from the opened base portion except for the metallic plate 5.

Since the operation of the embodiment of FIGS. 6A, 6B and 7A, 7B is the same as that of the above stated embodiments, the explanation thereof will be omitted.

[Embodiment 4]

Figure 8A:
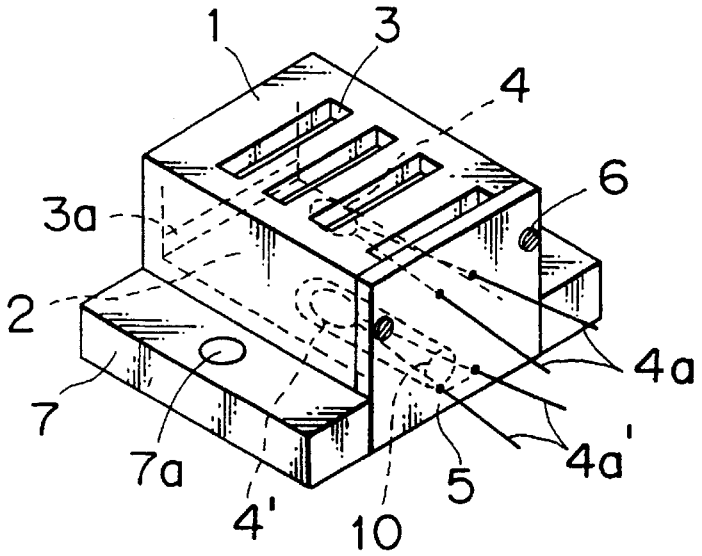
FIG. 8A is a perspective view showing the fourth embodiment of the frost detecting device according to the present invention.
Figure 8B:
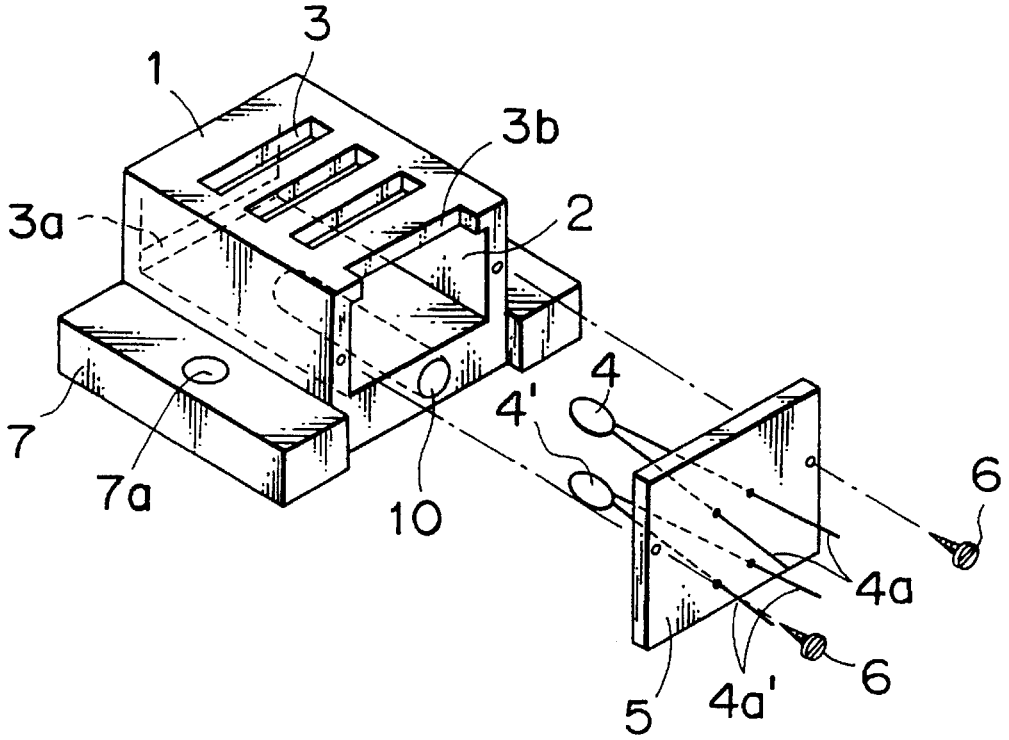
FIG. 8B is an exploded perspective view of FIG. 8A.

FIG. 8A is a perspective view showing the fourth embodiment of the frost detecting device according to the present invention, FIG. 8B is an exploded perspective view of FIG. 8A.

In FIG. 8A, designated 1 is a container which has thermal conductivity made of a metal such as Aluminum, Copper and so forth. Openings 3, 3*a*, and 3*b* are provided for the container 1.

A cavity 10 is bored into the base portion of the container 1. The thermally sensitive element 4' such as thermistor and so forth is inserted into the cavity 10. The thermally sensitive element 4' is sealed. A tongue-like piece 7 with a hole 7*a* for installing is provided for the container 1. The thermally sensitive element 4 characteristic of which is the same as the thermally sensitive element 4' is allocated to the inside of the hollow portion 2. The shape of the openings 3*a*, 3*b* are slit-like configuration, when the frost adheres the gap, ventilation of the air is prevented, the temperature at the hollow portions 2 is changed. Further, the openings 3*a*, 3*b* of the frost detecting device are the openings for draining the water on the inside of the hollow portion 2 after the defrosting. The thermally sensitive element 4' is received into the cavity 10 provided for the base portion of the container 1, and sealed by the resin and so forth detecting accurately the temperature change of the container 1.

Still more, the cavity for inserting the thermally sensitive element 4' is not limited to base portion of the container 1 as the embodiment. A cavity can be bored into the side portion of the container 1. The thermally sensitive element 4' is embedded in the cavity. It is clear that the thermally sensitive element 4' can be hermetically fixed into the cavity. On account of the provision that the openings 3*a*, 3*b* for draining water are provided for the container 1, the change of heat capacity caused by freezing of the water which accumulates in the hollow portion 2 is prevented. The difference in temperature is accurately measured and thereby the quantity of adhesion of the frost can be detected extremely precise.

In this embodiment, the difference in temperature between the thermally sensitive elements 4, 4' in the non-front adhered condition is large therefore, the difference in temperature in the condition that the openings 3*a*, 3*b* are completely blocked by the frost is not to be zero as the embodiments 2 or 3. However,It is possible for the output voltage to make zero by means of the bridge circuit as explained above. Further, the output voltage in the state of adhesion of the frost can be detected by a level detector.

In the embodiments 1 to 3, the metallic plate 5 is provided in order to fix the thermally sensitive elements 4, 4'. Accordingly the metallic plate 5 is not necessary to be metal. In particular, when the basic portion of the container is opened, the container might be integrally formed with the metallic plate 5. A material of the metallic plate 5 can be changed to a resin material.

If the openings which are blocked by the adhesion of the frost are formed on each surface of the container, the temperature of atmosphere with respect to the inside of the freezing instruments can be detected in every surface thereof.

[Embodiment 5]

Figure 9A:
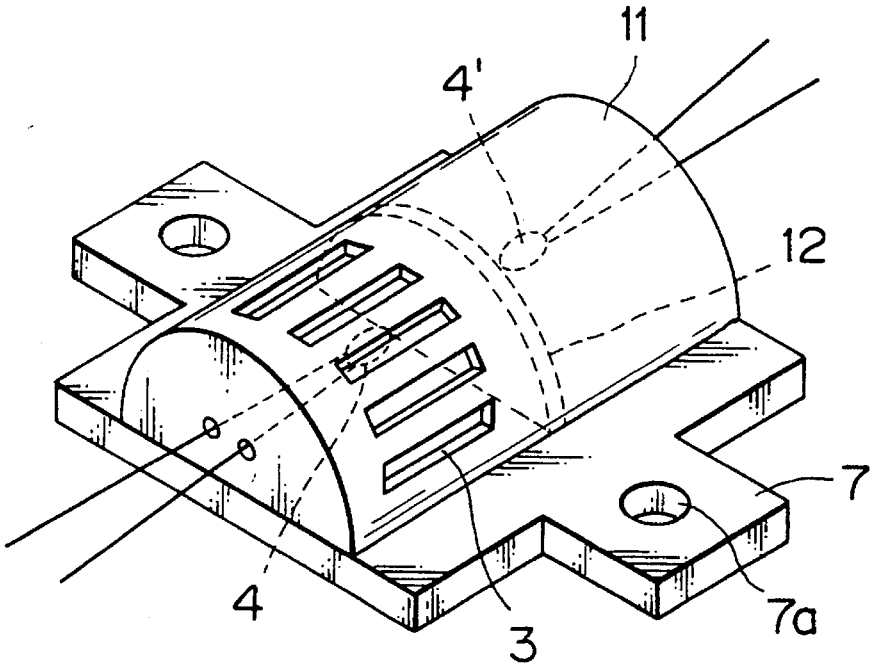
FIG. 9A is a perspective view showing the fifth embodiment of the frost detecting device according to the present invention.
Figure 9B:
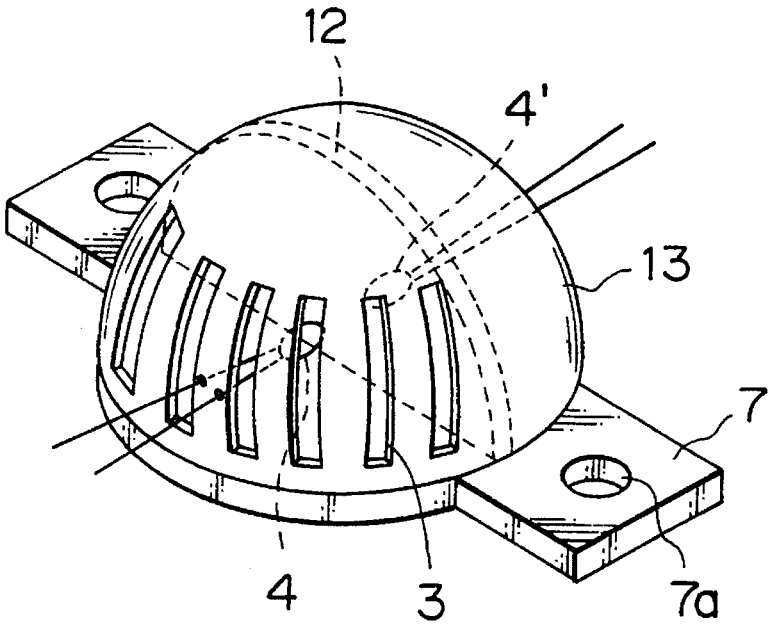
FIG. 9B is a perspective view showing the fifth embodiment of the frost detecting device according to the present invention.

FIGS. 9A, 9B are perspective view showing the fifth embodiment of the frost detecting device according to the present invention.

In FIG. 9A, there is provided the partition wall 12 for the container 11 which has thermal conductivity having semi-cylindrical shape. Two hollow portions are formed in the container 11. The container is made of the metal such as Aluminum or Copper and so forth. One hollow portion opens to the air outside through the opening 3 on the inside of the container 11. The thermally sensitive elements 4, 4' such as thermistor and so forth are mounting into the hollow portions. A tongue-like piece 7 with a hole 7*a* for installing is provided for the base plate of the container 11. The base plate can be disconnected from the container 11. The thermally sensitive elements 4, 4' are isolatedly fixed to the container 11. The thermally sensitive elements 4, 4' are installed into the container 11. Otherwise, the thermally sensitive elements 4, 4' are installed into the container 11 the base plate of which is opened. Subsequently, the base plate is integrally formed with the container. A screw is inserted into a hole 7*a* of the tongue-like piece 7 and is tightened into a threaded hole of the cooling fin. The thermally sensitive element 4' is sealed.

In FIG. 9B, there is provided the partition wall 12 for the container 13 having the shape of hemisphere. Two hollow portions are formed in the container 13. One hollow portion opens to the air outside through the opening 3 on the inside of the container 13. The thermally sensitive elements 4, 4' such as thermistor and so forth are mounting into the hollow portions. A tongue-like piece 7 with a hole 7*a* for installing is provided for the base plate of the container 13. The base plate is fixed to the container 13 by the screw. The thermally sensitive elements 4, 4' are isolatedly fixed to the base plate. The thermally sensitive elements 4, 4' are installed into the container 13. The thermally sensitive element 4' is sealed.

Further, the fifth embodiment is different from the first to the fourth embodiments. The opening 3 which are blocked by the frost are curved surface. Consequently, there is advantage that the current of air on the inside of the vessel of the freezing instruments can easily be introduced into the frost detecting device. The openings 3 had better open to the base plate so as to easily drain the water.

[Embodiment 6]

Figure 10A:
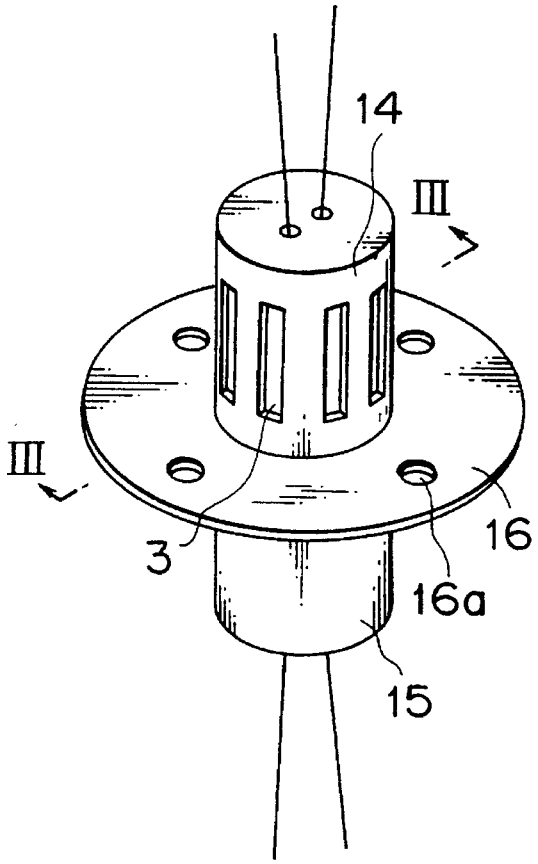
FIG. 10A is a perspective view showing the sixth embodiment of the frost detecting device according to the present invention.
Figure 10B:
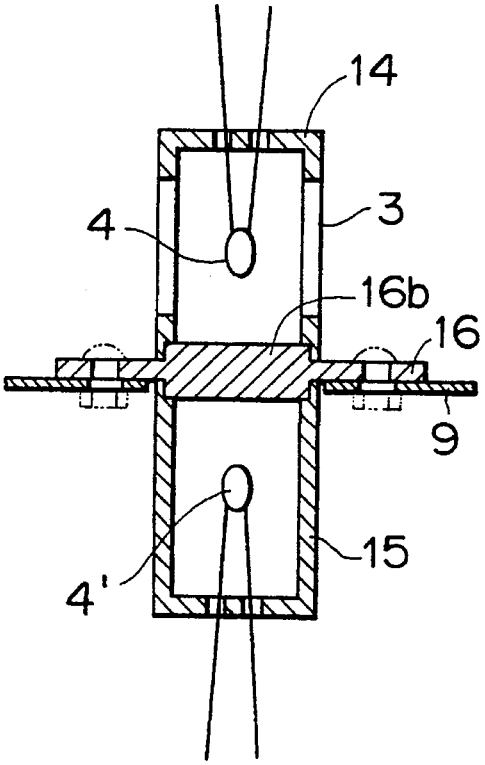
FIG. 10B is a cross sectional view taken along the line III—III of FIG. 10A.

FIG. 10A is a perspective view showing the sixth embodiment of the frost detecting device according to the present invention, FIG. 10B is a cross sectional view taken along the line III—III of FIG. 10A. In FIGS. 10A and 10B, designated 14, 15 are hollow cylindrical containers which have thermal conductivity made of a metal such as Aluminum, Copper and so forth. The openings 3 which are blocked by the frost provided for periphery portions of the container 14. The containers 14 and 15 are installed on the partition plate 16*b*. The partition plate 16*b* is integrally formed with the flange 16 having a hole 16*a* for installing. The containers 14 and 15 are fixed to the flange by using screws. The thermally sensitive elements 4, 4' such as the thermistor and so forth are mounting into the containers 14 and 15.

The frost detecting device is installed on the cooling fin 9. A hole is formed in the cooling fin 9. The container 15 is inserted into the hole. The bolts are inserted into the holes 16*a* for installing of the flange 16 tightening the bolts to fix the flange 16 in the cooling fin 9.

The current of air on the inside of the vessel for the freezing instruments is easily passing through the container 14 because the openings 3 are formed in the periphery of the container 14. Consequently, the adhesion of the frost can be very accurately detected.

[Embodiment 7]

Figure 11A:
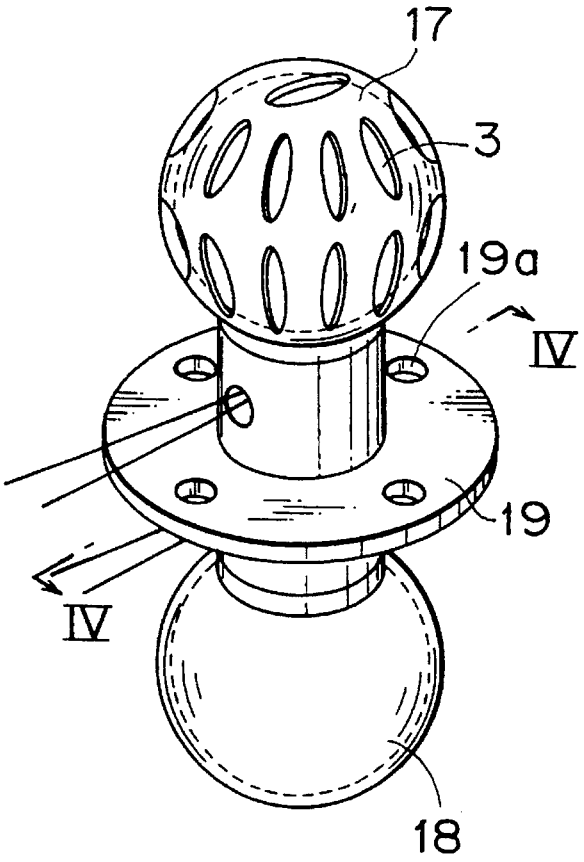
FIG. 11A is a perspective view showing the seventh embodiment of the frost detecting device according to the present invention.
Figure 11B:
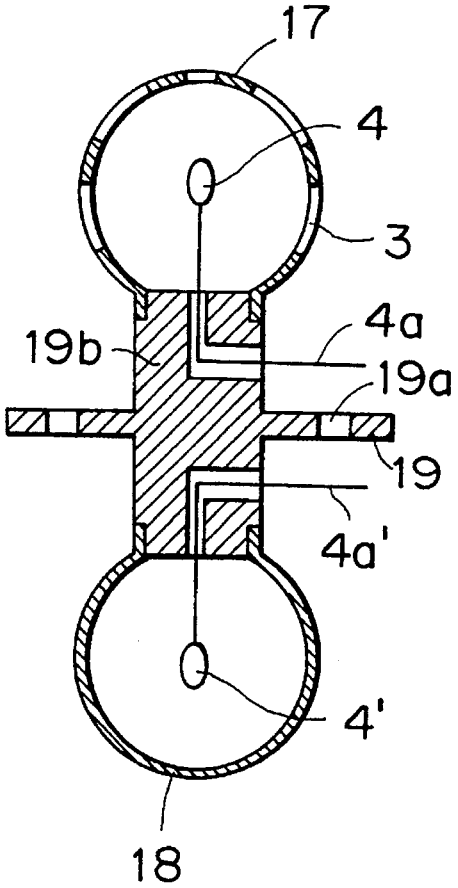
FIG. 11B is a cross sectional view taken along the line IV—IV of FIG. 11A.

FIG. 11A is a perspective view showing the seventh embodiment of the frost detecting device according to the present invention. FIG. 11B is a cross sectional view taken along the line IV—IV of FIG. 11A.

In FIGS. 11A and 11B, designated 17 and 18 are spherical containers. The openings 3 are formed all over the surface of the container 17. The containers 17, 18 have thermal conductivity made of a metal such as Aluminum, Copper and so forth. The containers 17 and 18 are fixed to the partition plate 19*b* by using screws. The partition plate 19*b* is integrally formed with the flange 19. The flange 19 with the containers 17 and 18 is fixed on the cooling fin so as to project from each side of the cooling fin on the inside of the heat exchanger. The thermally sensitive elements 4, 4' such as the thermistor and so forth are mounting into the containers 17 and 18. Leads 4*a*, 4*a'* of the thermally sensitive elements 4, 4' are firmly fixed isolatedly to the partition plate 19*b*. The leads 4*a*, 4*a'* are inserted through into a penetration of the partition plate 19*b*.

In this embodiment, since the openings 3 are provided for whole surface of the spherical container 17, the omnidirectional ambient temperature of 360 degree can be detected. The temperature on the inside of the freezing instruments is detected by means of the thermally sensitive element 4 on the inside of the container 17, and that of the cooling fin is detected by means of the thermally sensitive element 4' on the inside of the container 18. Consequently, the adhesion of the frost can be very accurately detected. Besides, in this embodiment, although the openings 3 are provided for whole surface of the spherical container 17, it is clearly permitted that the shape of the openings are slit-like configuration.

[Embodiment 8]

Figure 12:
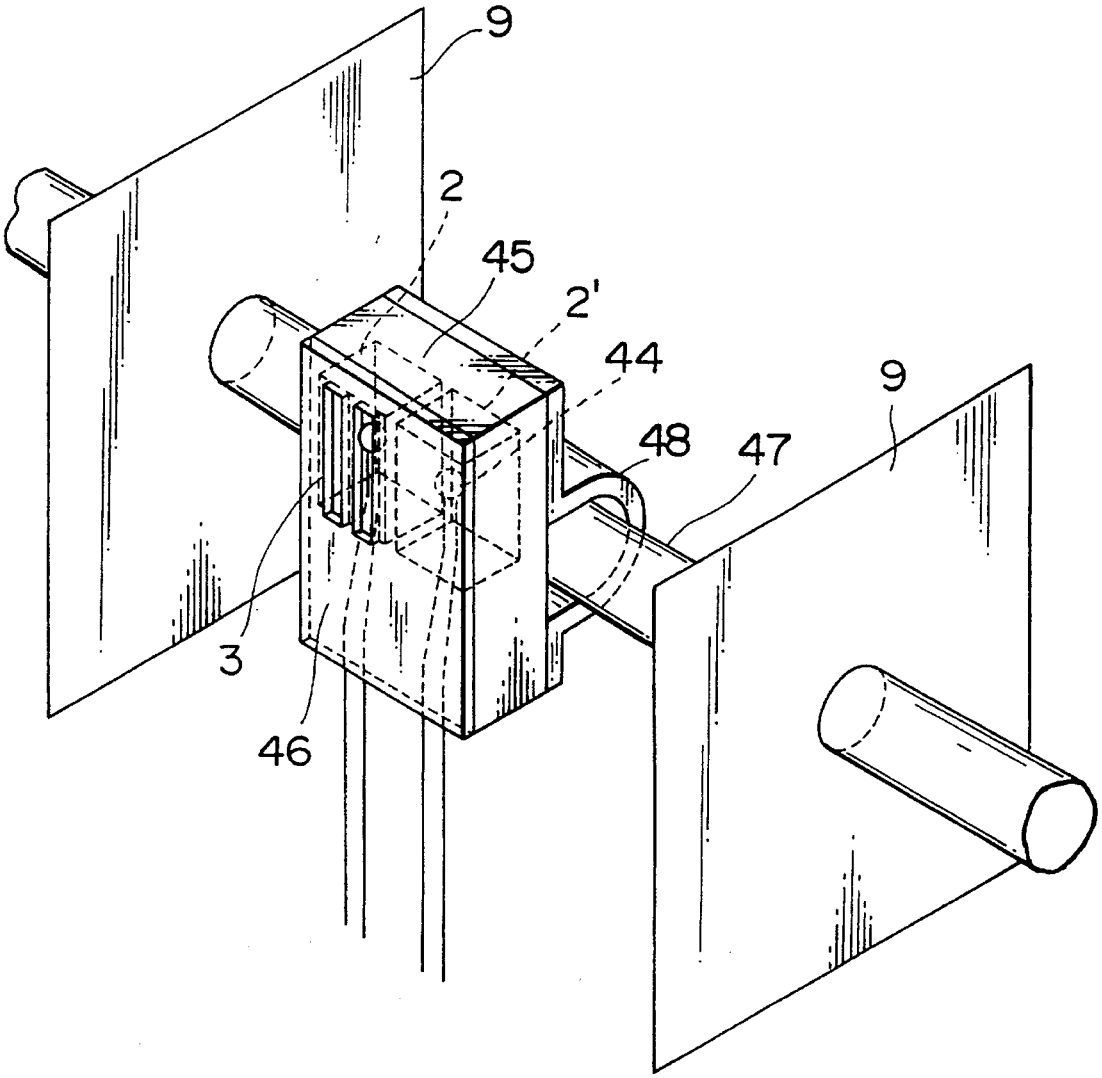
FIG. 12 is a perspective view showing eighth embodiment of the frost detecting device according to the present invention.
Figure 13A:
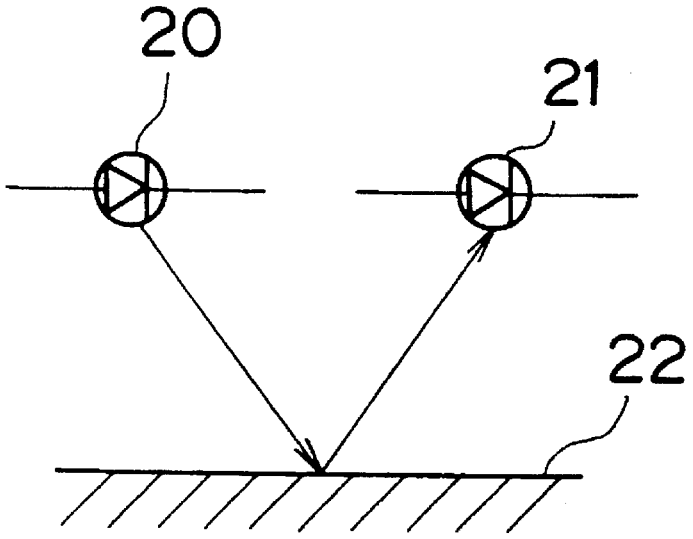
FIG. 13A is an explanately view showing a conventional optical frost detecting device.
Figure 13B:
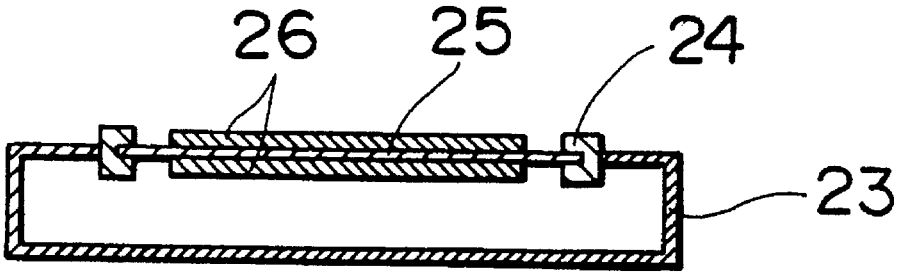
FIG. 13B is a cross sectional view showing a conventional frost detecting device of the piezoelectric vibrator.

FIG. 12 is a perspective view showing eighth embodiment of the frost detecting device according to the present invention. Designated 9 is the cooling fin. A thermally sensitive element 44 is fixedly contained on the inside of the container 45 with covering by the lid 46. Designated 47 is a cooling pipe on the inside of which refrigerant flows. The thermally sensitive element 44 is installed on the cooling pipe 47 in such a manner that the cooling pipe 47 is caught between the container 45 with the lid 48 and a metallic mounting means 48.

As stated above, in the frost detecting device according to the present invention, the ambient temperature on the inside of the freezing instruments is detected in such a way that the temperature of the air outside atmosphere is detected by means of the thermally sensitive element through the openings, when the openings are entirely blocked by adhesion of the frost, the temperature on the inside of the container becomes approximately the same temperature as the cooling fin. The previous temperature of adhesion of the frost is detected in advance. The transition of temperature after adhesion of the frost is also detected. The both of temperatures are compared with each other. Thus the frost detecting device can detect the adhesion of the frost from the difference in temperature.

Further, in the temperature detection, two hollow portions are provided for the container. One of two hollow portions is employed for compensating the temperature, and thereby the frost detecting is accurately performed.

The container concerning each of the first to eighth embodiments of the frost detecting devices is made of metal such as zinc, iron, titanium or an alloy which is made of the principal ingredients of aluminum, copper, zinc, iron and titanium. Further the container can be made of ceramic with high thermal conductivity for example, boron nitride (B N), aluminum nitride (Al N), silicon carbide (Si C), and beryllium oxide (Be O).

It is clear that the openings 3*a*, 3*b* for draining as shown in FIGS. 8A, 8B are applicable to the another embodiments.

In the above described embodiments, although the metallic plate is fixed to the container by the screws, the metallic plate can be fixed to the container by welding. The metallic plate can be made of resin. When the base surface of the container 1 is opened, the container 1 can be integrally formed with metallic plate 5.

In the above described embodiments, although the slit-like shape is suitable for the openings provided for the container as shown in the embodiments, the slit-like openings may be H-like shape, T-like shape or shape in no-parallel shape. Further the shape of the openings can be substantially one opening which is composed of a plurality of radiate slits.

It is favorable to provide a thicker section for the inside of the side wall of the openings so as to easily adhere the frost. The wider the opening is formed, the longer time is spent for blocking the openings. The reverse is true. Consequently, it is favorable to set the width of the slit in accordance with the predetermined quantity of adhesion of the frost.

Further, with regard to the width of the slit, it is favorable to form width of the slit so as not to close the slit by surface tension of the water generated caused by melting the frost in case of defrosting. Furthermore, it is favorable to mount the frost detecting device in such a manner that the length of the slit becomes up and down so that a water drop easily falls along the slit.

As described above, the frost detecting device according to the present invention both the ambient temperature on the inside of the vessel of freezing instruments and the temperature of the state where the openings are blocked by the adhesion of the frost are detected by means of the thermally sensitive element arranged on the inside of the container which has high thermal conductivity with the openings wherein the state of adhesion of the frost is detected by difference in temperature. There is an advantage that it is hard to be affected by the adhesion of dust and an environmental condition.

Further, the frost detecting device according to the present invention, both the temperature of non frost state and the temperature of adhesion of the frost state in which the openings are blocked are detected by means of the thermally sensitive element arranged on the inside of the one hollow portion which is provided for the frost detecting device having the opening.

The temperature on the inside of the container (the temperature of the cooling fin) is detected by means of the thermally sensitive element arranged on the inside of the other hollow portion.

The thermally sensitive element arranged on the inside of the hollow portion which is best affected by the cooling fin is employed as the temperature compensation element. Therefore, there is an advantage that this is good at the environmental condition. Since it can be balanced the external temperature condition with the thermally sensitive element for compensating temperature, there is an advantage that the quality of adhesion of the frost certainly detected by virtue of detecting accurately difference in temperature with good reproduction.

Moreover, the frost detecting device according to the present invention has very simple construction compared with the conventional frost detecting device. There are advantages that not only it is hard to be affected by adhesion of dust and an environmental condition, but also it is easy to perform manufacture, maintenance, and inspection. There is also an advantage that the manufacturing cost is cheap.

Moreover, if the frost detecting device according to the present invention is employed as the frost detecting device of the defrosting device for the freezing instruments, it can accurately be detected the starting point of the defrosting. Accordingly, it is possible to perform the efficient refrigerating operation of the energy efficiency because the defrosting operation can be performed by meeting the demand of necessity.

Moreover, the frost detecting device according to the present invention in which the container is made of the materials the quality of which has good thermal conductivity. Accordingly, it's possible to heighten detecting accuracy of thermal response property. The container has the curved surface such as a spherical shape or cylindrical shape.

The temperature in atmosphere on the inside of the freezing instruments is efficiently detected. Consequently, the adhesion of the frost can be very accurately detected.

What is claimed is:

1. A frost detecting device comprising:

a container which has thermal conductivity;

a thermally sensitive element provided within said container for measuring environmental temperature inside of said container; and openings which are blocked by adhesion of frost, provided on one side of said container.

2. A frost detecting device according to claim 1, wherein said container with respect to frost detecting device has at least one of a rectangular parallelepiped shape, semicylindrical shape and spherical shape.

3. A frost detecting device according to claim 1, wherein said openings with respect to the frost detecting devices are formed into slit-like shape.

4. A frost detecting device according to claim 1, wherein said container with respect to the frost detecting devices is made of each of aluminum, zinc, copper, iron, titanium or an alloy which is made of the principal ingredients thereof.

5. A frost detecting device according to claim 1, wherein at least one of said openings is used both for temperature detection and drainage.

6. A frost detecting device according to claim 1, wherein a width of a slit-like opening with respect to said frost detecting devices is employed for establishment of quantity of adhesion of the frost.

7. A frost detecting device according to claim 1, further comprising metallic mounting means for attaching said frost detecting device to a cooling pipe so that said cooling pipe is situated between said container and said metallic mounting means.

8. A frost detecting device comprising:

a container which has thermal conductivity;

a first and a second hollow portions formed on an inside of said container;

openings which are blocked by adhesion of the frost, provided for the first hollow portion of said container;

a first thermally sensitive element mounting into the first hollow portion; and a second thermally sensitive element mounting into the second hollow portion.

9. A frost detecting device comprising:

a container which has thermal conductivity;

a first thermally sensitive element mounting into said container;

openings which are blocked by adhesion of the frost, provided for said container; and a second thermally sensitive element hermetically fixed into a cavity bored into a formative part of said container.

10. A frost detecting device comprising:

a first and a second containers each shape of which is cylindrical shape or spherical shape, having thermal conductivity;

openings which are blocked by adhesion of the frost, provided for said first container;

a partition wall which is provided between the first and the second containers;

a flange which is provided at about the center of the first and the second containers; and a first and a second thermally sensitive elements mounting into the first and the second containers respectively.

* * * * *